US005641274A

United States Patent [19]

Kubo et al.

[11] Patent Number: 5,641,274

[45] Date of Patent: Jun. 24, 1997

[54] TWO STAGE FUEL INJECTION PUMP WITH SECOND STAGE LOCATED IN THE FIRST STAGE INLET LINE

[75] Inventors: Kenichi Kubo; Tsumayoshi Motoyoshi; Jun Matsubara, all of Higashimatsuyama, Japan

[73] Assignee: Zexel Corporation, Tokyo, Japan

[21] Appl. No.: 413,438

[22] Filed: Mar. 30, 1995

[30] Foreign Application Priority Data

Mar. 31, 1994 [JP] Japan ..... 6-085508

[51] Int. Cl.[6] ..... F04B 23/10; F04B 19/02

[52] U.S. Cl. ..... 417/206; 417/462; 123/450

[58] Field of Search ..... 417/206, 244, 417/364, 462; 123/450

[56] References Cited

U.S. PATENT DOCUMENTS

| | | | |
|---|---|---|---|
| 4,292,012 | 9/1981 | Botherston | 123/450 |
| 4,601,274 | 7/1986 | Seilly | 417/462 |
| 4,915,592 | 4/1990 | Hishinuma et al. | 417/206 |
| 5,318,001 | 6/1994 | Djordjevic | 417/462 |
| 5,383,436 | 1/1995 | Fehlmann | 123/450 |

FOREIGN PATENT DOCUMENTS

| | | |
|---|---|---|
| 0303237 | 2/1989 | European Pat. Off. . |
| 835906 | 5/1960 | United Kingdom . |
| 2141786 | 1/1985 | United Kingdom . |

*Primary Examiner*—Timothy Thorpe
*Assistant Examiner*—Roland G. McAndrews, Jr.
*Attorney, Agent, or Firm*—Wenderoth, Lind & Ponack

[57] ABSTRACT

A low pressure side fuel path extending from a fuel inflow port to a feed pump, and a chamber, which can communicate with an inflow/outflow port, are formed by partitioning inside a housing. A cam ring, shoes and rollers are provided in the low pressure side fuel path to induce low pressure, low temperature fuel into the area surrounding the rollers. A space that communicates with the low pressure side fuel path without constriction is formed on the upstream side on the back surfaces of the shoes. A phase of the cam ring and the control sleeve is fixed with the adapter provided on the boundary of the low pressure side fuel path and the chamber. An intake passage communicating with the intake port may be formed in the adapter to shorten the intake path. The area around the rollers, which tends to become heated in an inner-cam type fuel injection pump, is cooled efficiently, cam jump is reduced, control of advance angle is performed separately and independently of the fuel injection quantity control, and the efficiency of fuel intake is improved.

13 Claims, 9 Drawing Sheets

FIG. 2
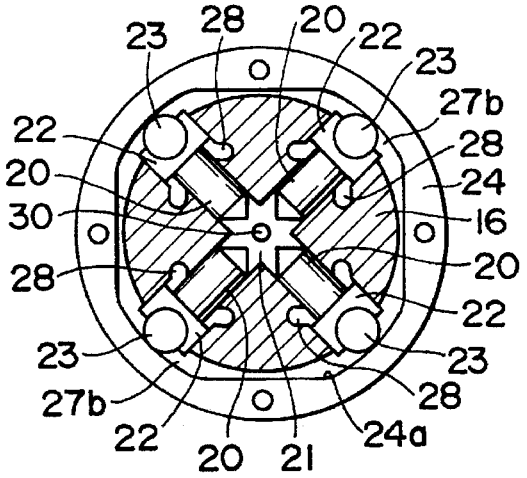
FIG. 3A
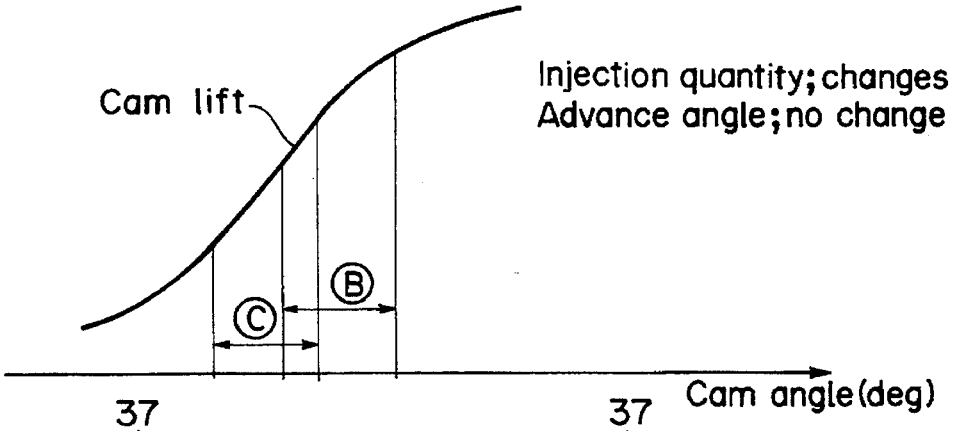
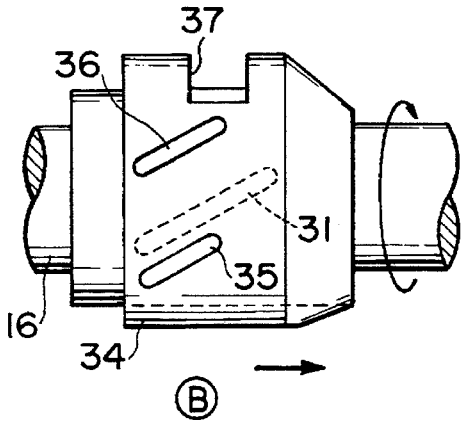
FIG. 3B
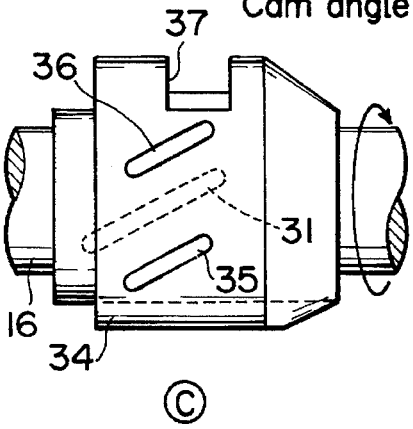
FIG. 3C

FIG. 4A
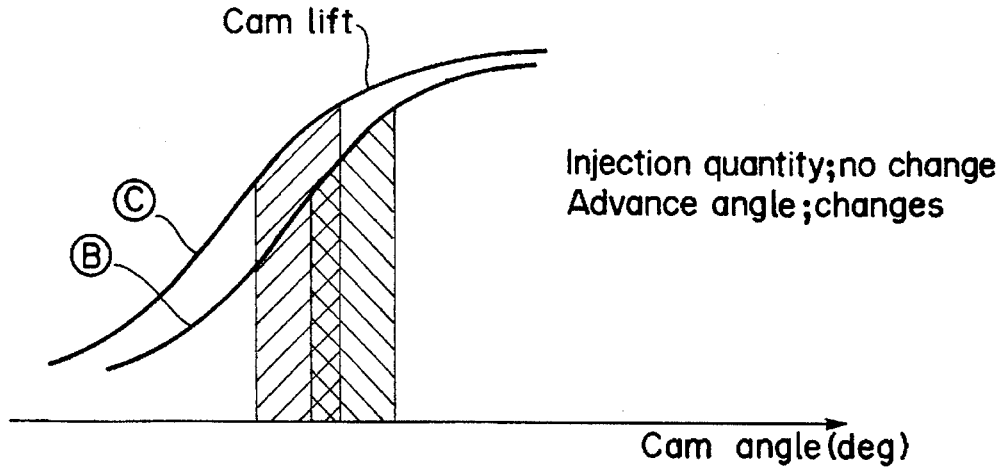
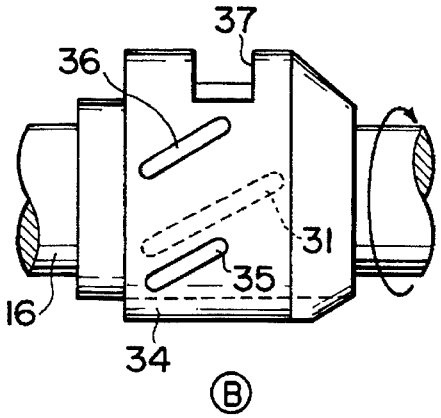
FIG. 4B
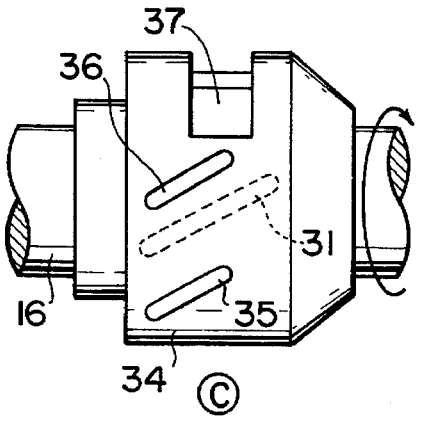
FIG. 4C

TWO STAGE FUEL INJECTION PUMP WITH SECOND STAGE LOCATED IN THE FIRST STAGE INLET LINE

BACKGROUND OF THE INVENTION

1. Field of the Invention

The present invention relates to an inner-earn system, distributor type fuel injection pump used for supplying fuel to engines such as diesel engines, i.e., a fuel injection pump in which a plunger makes reciprocal movement against a rotating reenter, which is synchronized with the engine, in the direction of the radius of the rotating member.

2. Description of the Related Art

Distributor type fuel injection pumps which employ the inner-earn system in the known art include those disclosed on page 2 and page 4 and in FIG. 1 and FIG. 7 of Japanese Unexamined Patent Publication No. S59-110835. In this type of pump, an inner-cam ring 1 is provided concentrically around a fuel distribution rotating member 4 (rotating member) inside a fuel chamber 121 (chamber) and on the earn surface, which is formed on the inside of the inner-cam ring 1, compression plungers 21, 22 are provided via rolling elements 23, 24 (rollers) and shoes 25, 26. The compression plungers 21, 22 make a reciprocal movement in the direction of the radius of the fuel distribution rotating member 4. A pump chamber 2 (compression space) whose volumetric capacity is changed by the compression plungers 21, 22, intake holes 51, 54 for drawing the fuel in to the pump chamber 2 during the intake process, a distribution port 6, for sending out the fuel that has been pressurized in the pump chamber 2 during the compression process, and overflow ports 71, 74 for cutting off the fuel supply are formed in the fuel distribution rotating member 4, which is externally fitted with an oil-tight ring-like member 7 (control sleeve), that covers the overflow ports 71 and 74. A diagonal lead groove portion 10 for cut off is formed on the inner surface of the ring-like member 7 and by adjusting the position of the ring-like member 7 in the axial direction of the shaft with a linear solenoid 81, the cutoff timing during the compression process (the timing with which the overflow ports opens into the diagonal lead groove portion to release compressed fuel into the fuel chamber 121) can be varied to change the fuel injection quantity.

In addition, in FIG. 1 of Japanese Unexamined Patent Publication No. S59-65523, a distributor type fuel injection pump employing the inner-cam system is disclosed, in which fuel that has been taken in by a feed pump is decompressed with a constriction 23 and then induced to a low pressure fuel reservoir or chamber 24 where shoes 4 provided at the base end of the plungers 3, rollers 5 supported by the shoes 4 and a cam ring 6 with which, the rollers are in contact, are provided. With this fuel injection pump, the fuel in the low pressure fuel reservoir 24 can be supplied to the intake port 20 of the rotating member 1 and, at the same time, it can be supplied to the space enclosed by the cam ring 6 and the rotating member 1. In this structure too, while the fuel which is retained in the rotor 1 is compressed during the compression process, the injection is cut off when the compressed fuel escapes via the bypass pert 36.

However, when the space into which the fuel flows during this cut off period communicates with the space surrounding the rollers, as in the fuel injection pumps described above, even if the fuel pressure is reduced by the constriction 23, as in Japanese Publication No. S59-65523, the temperature inside the chamber increases, as the high-temperature, high pressure fuel that has been compressed during the compression process, flows out to the chamber. This results in insufficient cooling of the contact area between the cam ring and the rollers and also the contact area between the rollers and the shoes, where friction heat tends to be generated.

SUMMARY OF THE INVENTION

Accordingly, the main object of the present invention is to achieve efficient cooling of the contact areas around the rollers where heat is likely to be generated.

In order to achieve the object described above, a possible solution might be partitioning to form a space surrounding the rollers and a separate chamber, communicating with the fuel inflow/outflow port. However, if they are simply partitioned, there is the likelihood of fuel becoming idle around the rollers. In particular, when the rollers are rotating at high speed, the quantity of heat contained in and around the rollers increases and this tends to cause an oil film loss of the fuel which is involved in lubrication of the area surrounding the rollers, hastening the process of wear. Therefore, this is a point that must be considered.

Moreover, if the rollers or the shoes jump (cam jump) along with the reciprocal movement of the plungers, stable injection characteristics cannot be achieved. Therefore, it is necessary to inhibit such cam jumps. The force that must be applied to the rollers and shoes towards the cam ring for suppressing cam jump is greater than might be expected. Thus, a structure that achieves the largest possible reduction of cam jump is desirable.

Furthermore, if the fuel injection quantity is controlled by adjusting the position of the control sleeve in the direction of the shaft of the rotating member, as in Japanese Publication No. S59-110835, it is necessary to perform positioning in synchronization with the quantity of the advance angle of the timer, and if the area surrounding the rollers and the chamber are to be partitioned off from each other, handling this matter of positioning presents a problem. Theoretically, a method in which advance angle correction for the control sleeve is performed by setting a correction quantity through comparison of the outputs from a position sensor for the control sleeve and the timer position sensor might be considered. However, accuracy cannot be assured among various sensors, so there is a problem as far as control accuracy is concerned.

In addition, when the quantity of fuel that is force-fed from the compression space increases, the quantity of fuel to be taken in during the intake process also naturally increases. This requires that we take into consideration the following: that it is necessary to secure an intake path which affords good intake efficiency, particularly during high oil supply, and that if a failure of an electric governor causes the control sleeve to shift by a larger quantity than necessary in the direction in which the cut off is delayed, the interior of the pump and components of the engine driving the pump are likely to be damaged due to an abnormal increase in pressure.

Consequently, associated objects of the present invention are to achieve stable fuel characteristics by reducing cam jump and to provide a distributor type fuel injection pump with which positioning of the control sleeve in conformance with the movement of the timer can be performed with a high degree of accuracy and with which timer control and fuel injection quantity control are performed independently of each other so that, when performing one control, it is not necessary to take into consideration the other control.

Yet another object of the present invention is to improve the efficiency with which fuel is taken in while preventing damage to the pump and the like, even if the electronic governor fails.

Through research into various fuel injection systems that employ the inner-cam system, the inventor of the present invention has reached the conclusion that it is preferable to locate the contact areas with the rollers outside the chamber and the present invention has been completed to address the various problems described earlier, which result from this structure.

Namely, a distributor type fuel injection pump according to the present invention is provided with a housing that includes a rotating member that rotates in synchronization with the engine, plungers that are provided in the direction of the radius of the rotating member and that change the volumetric capacity of a compression space formed in the rotating member, a cam ring that is formed around the rotating member and concentric to it, shoes that are shoes and the cam ring. The rotating member includes ports that take in, shoes and the cam ring, with ports formed in the rotating member that take in, send out and cut off fuel by communicating with the compression space. The inside of the housing is partitioned into a low pressure side fuel path that extends from the fuel inflow port to the upstream side of the feed pump, and a chamber that can communicating with the ports into which the fuel that has been pressurized by the feed pump is induced and where the fuel is taken in or cut off. The cam ring, the shoes and the rollers are located in the low pressure side fuel path in a first embodiment of the present invention.

Formation of a low pressure side fuel path and a separate chamber can he achieved with the feed pump in a structure in which the fuel inflow port, the feed pump and the chamber are arranged in that order in the direction of the shaft of the rotating member. In a structure in which the chamber is positioned between the fuel inflow port and the feed pump, a partitioning wall should be provided so that a chamber is formed within the housing.

It should be noted that it is desirable to create a space between the back surfaces of the shoes and the rotating member and that this space communicate with the low pressure side fuel path without constriction toward the fuel inflow port as in a second embodiment of the present invention. It is also desirable to externally fit an oil tight control sleeve on to the rotating member in which, at least, a cutoff hole is formed that can communicate with the port for cutting off the fuel, to externally fit an oil tight, ring-like adapter on to the rotating member that synchronizes with the cam ring, and to perform positioning of the control sleeve relative to this adapter by using it as a part of the member which partitions the low pressure side fuel path and the chamber as in a third embodiment of the present invention.

Furthermore, it is desirable to form a fuel intake port in an area covered by the adapter and to form an intake passage that makes communication between the chamber and the fuel intake port possible via the adapter which constitutes a part of the member that separates the low pressure side fuel path from the chamber as in a fourth embodiment of the present invention. Note that this intake passage may communicate between the fuel intake port and the chamber when the lift exceeds a specific level during the compression process, in order to set the effective stroke at an allowable maximum value. According to the first embodiment, since the inside of the housing is separated into a low pressure side fuel path and a chamber with the feed prop used as a partition, and, at the same time, the cam ring, the shoes and the rollers are provided in the low pressure side fuel passage, the low temperature, low pressure fuel that flows in through the fuel inflow port is induced to the feed pump after travelling through the gap between the cam ring and the shoes and the rollers. This promotes cooling of the area around the rollers where friction heat tends to be generated.

In particular, if a space is created between the hack surfaces of the shoes and the rotating member, and this space and the low pressure side fuel path are made to communicate with each other without constriction toward the fuel inflow port, as in the second concept, the fuel pressure becomes reduced due to the passage resistance through the cam ring, the shoes and the rollers. This causes a pressure differential to he created between the cam ring side of the shoes and the rotating member side of the shoes and with this pressure differential, a force is applied to the rollers and the shoes towards the cam ring.

In addition, if the fuel injection pump is structured as designed in the third embodiment, the phase relationship between the control sleeve, which controls the timing with which the fuel is cut off, and the cam ring is fixed. As a result, when the cam ring is rotated and the advance angle is changed, the control sleeve is also rotated, precluding the necessity for correcting the injection quantity when the advance angle changes. Thus, the advance angle and the injection quantity are controlled separately and independently.

Moreover, with a structure as designed in the fourth embodiment, the fuel inside the chamber is induced to the compression space via the intake passage formed in the adapter and also via the fuel intake port covered by the adapter. This means that the intake path can be shorter, compared with the structure in which fuel is taken in from the middle of the chamber, achieving the objects described earlier.

BRIEF DESCRIPTION OF THE DRAWINGS

These and other advantages, features and objects of the present invention will be understood by those of ordinary skill in the art referring to the annexed drawings, given purely by way of non-limiting example, in which;

FIG. 2 shows the cam ring of FIG. 1 and the members inside it, viewed from the direction of a shaft of a rotating member;

FIGS. 3A–3C illustrate the change in the injection quantity when a control sleeve is moved in the direction of the shaft of the rotating member;

FIGS. 4A–4C illustrate the change in the advance angle when a control sleeve is rotated of the direction of the circumference of the rotating member;

DETAILED DESCRIPTION OF THE PREFERRED EMBODIMENTS

The following is an explanation of the embodiments of the present invention in reference to the drawings.

Figure 1:
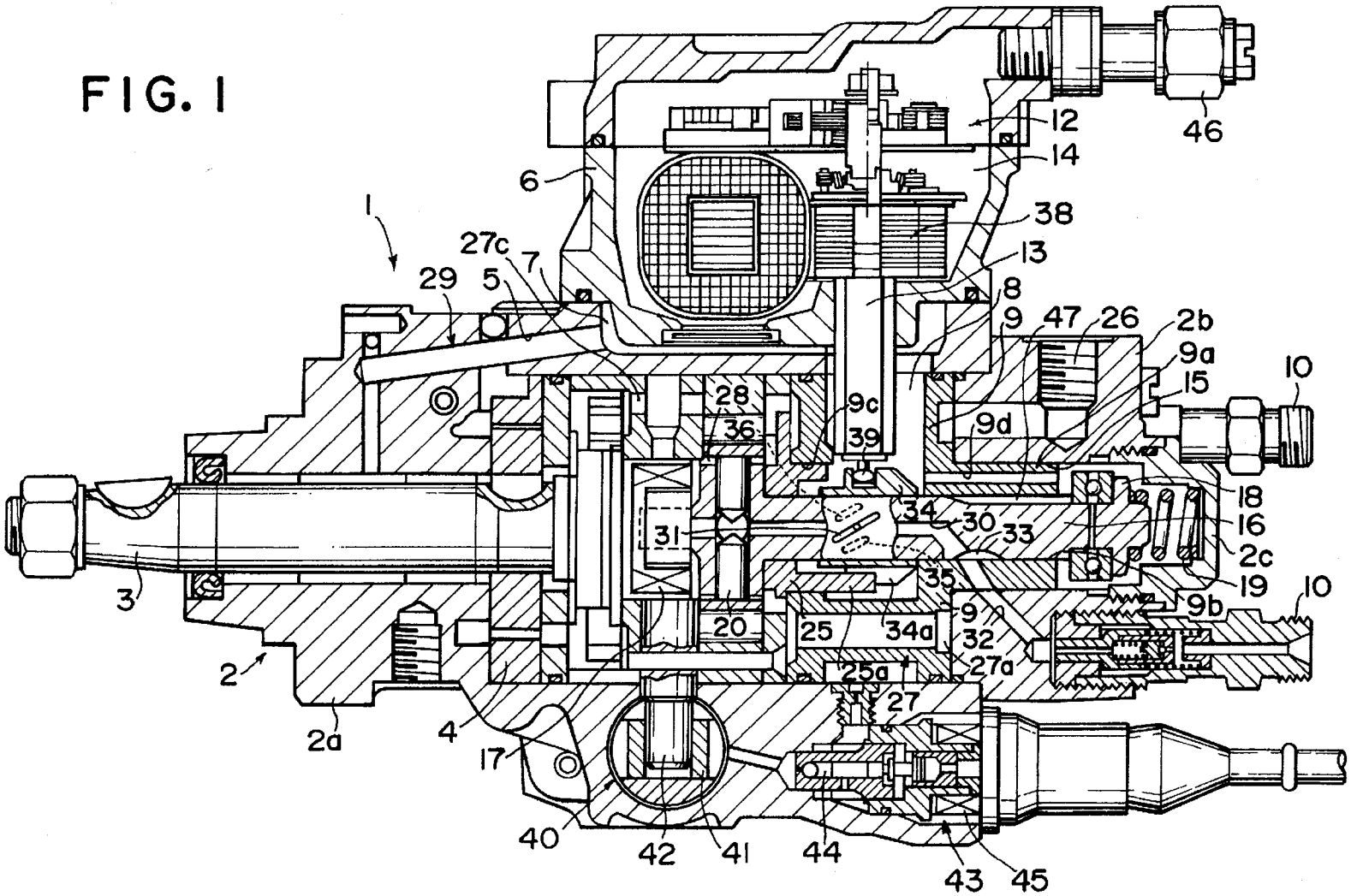
FIG. 1 is a cross section of a distributor type fuel injection pump according to a first embodiment of the present invention.

In FIG. 1, which shows a distributor type fuel injection pump employing an inner-cam system, a drive shaft 3 of the distributor type fuel injection pump 1 is inserted in a pump housing 2, and one end of the drive shaft 3 protrudes out of the pump housing 2 to receive drive torque from an engine (not shown) so that the drive shaft 3 rotates in synchronization with the engine. The other end of the drive shaft 3 extends into the pump housing 2 and a feed pump 4 is linked with the drive shaft 3. This feed pump 4 supplies fuel from a low pressure side fuel path, which is to be explained later, to a chamber 8.

The pump housing 2 includes a housing member 2*a*, through which the drive shaft 3 is inserted, a housing number 2*b*, which is mounted on the housing member 2*a* and which is provided with outlet valves 10 and a housing member 2*c* which blocks off the open end of the housing member 2*b*. The chamber 8 is constituted of the space that is enclosed by a partitioning body 9, which is secured within the pump housing, and an adapter 25, which is to be explained later. The partitioning body 9 forms a space that contains the shaft 13 of an electronic governor 12, to be explained later, and the partitioning body 9 is tightly bonded to the pump housing 2 via an O-ring in such a manner that the space communicates with a storage chamber 14 of the governor 12, which is formed by partitioning a governor housing 6. This partitioning body 9 is also provided with a fitting protrusion 9*a* formed as a unit with the partitioning body 9, located on the side of the partitioning body. This fitting protrusion 9*a* is fitted inside a rotating member insertion portion 15 of the housing member 2*b* which is provided with the outlet valves.

A rotating member 16 is supported with a high degree of oil tightness by an insertion portion 9*b*, which passes through the partitioning body 9, the front end area of which is formed at the fitting protrusion 9*a* and, at the same time, in such a manner that the rotating member can rotate freely. The base end of the rotating member 16 is linked to the drive shaft 3 via a coupling 17 in such a manner that only rotation is allowed as the drive shaft 3 rotates. Also, a spring 19 which is provided between a spring receptacle 18 formed at the front end of the rotating member 16, and the housing member 2*c*, applies a force to the rotating member 16 towards the coupling, preventing play in the direction of the shaft.

Plungers 20 are inserted in the base end of the rotating member 16 in the direction of the radius (radial direction) in such a manner that they can slide freely. In this embodiment, as shown in FIG. 2, four plungers 20 are provided at intervals of, for instance, 90° on the same plane and the front end of each plunger 20 is positioned so as to block off a compression space 21 formed at the center of the base end of the rotating member 16. The base end of the plungers 20 slide while in contact with the inner surface of a cam ring 24 via the shoes 22 and the rollers 23. This cam ring 24 is provided concentrically with and around the rotating member 16. Inside the cam ring 24, cam surfaces 24*a* are formed, the number of which corresponds to the number of cylinders of the engine. When the rotating member 16 rotates, the plungers 20 make reciprocal motion in the direction of the radius (radial direction) of the rotating member 16 to change the volumetric capacity of the compression space 21.

In other words, to support a four-cylinder engine, protruding surfaces should be formed at intervals of 90° on the inside of the cam ring 24 so that four plungers 20 move simultaneously toward the center of the cam ring 24 to shrink the compression space 21 and, alternately, they move simultaneously away from the center of the cam ring 24 to expand the compression space 21.

An oil tight ring-like adapter 25 is fitted externally between the front end and the base end of the rotating member 16 in such a manner that it can rotate freely. Part of the circumferential edge of the adapter 25 is connected and stopped by the cam ring 24 so that its rotation is restricted and its position is determined relative to the cam ring 24. Also, a cylindrical portion 25*a* of the adapter 25, which projects out towards the front end of the rotating member 16, fits oil tight into a fitting hole 9*c* which is formed in the partitioning body 9 in such a manner that it can rotate freely.

Figure 5:
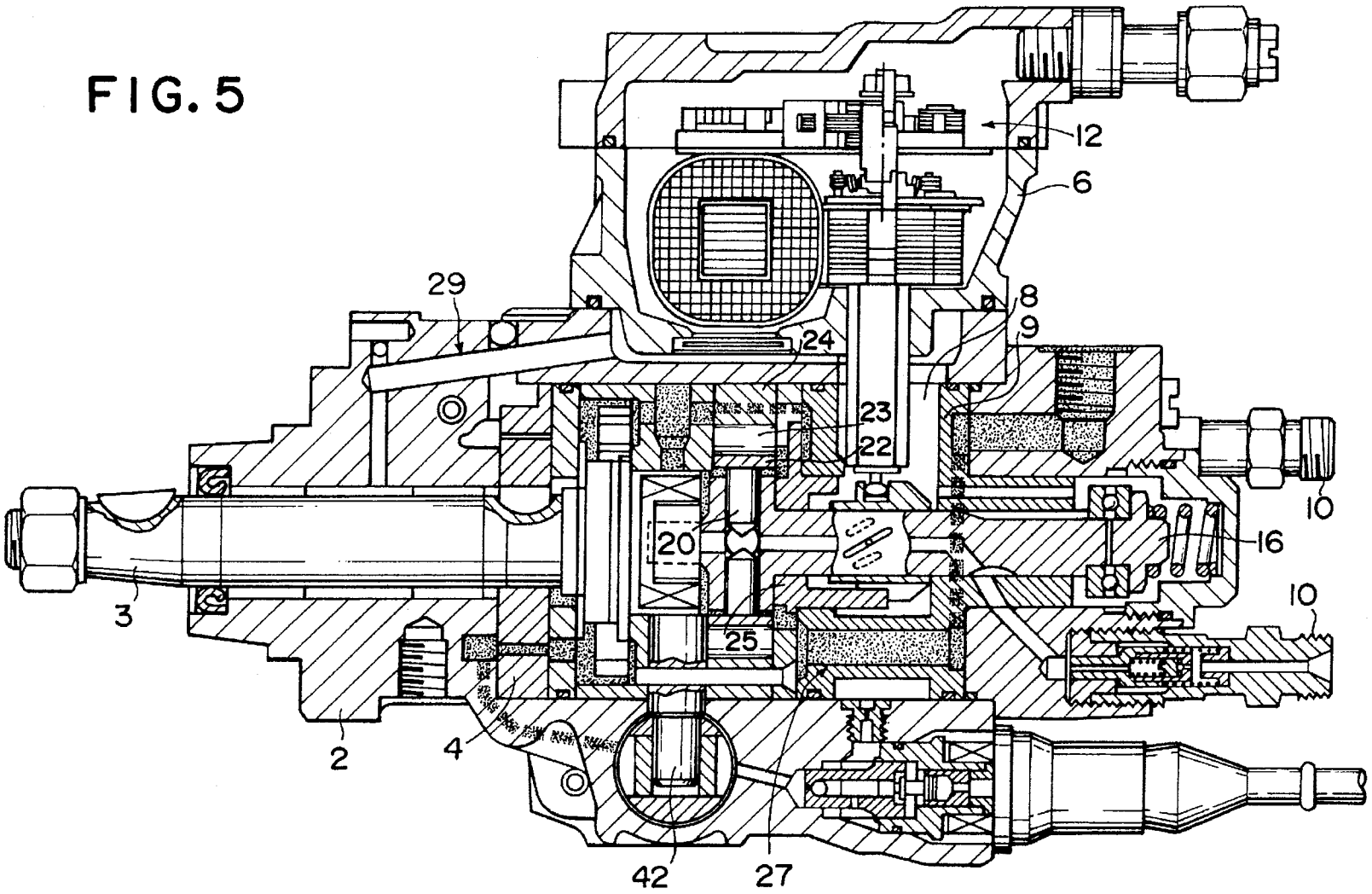
FIG. 5 illustrates a low pressure side fuel path in the distributor type fuel injection pump in FIG. 1.

In the housing member 2*b*, which is provided with the outlet valves 10, a fuel inflow port 26, which communicates with the fuel tank is further provided. The fuel that flows in through the fuel inflow port 26 is induced toward the suction side of the fuel pump 4 via a space 27*a*, formed around the partitioning body 9 and the adapter 25 in the pump housing, a space 27*b* formed between the cam ring 24 and the rotating member 16, a passage 27*c* formed around the coupling 17 and the like. These spaces and the passage constitute the low pressure side fuel path 27 (the area that is illustrated by sanding over in FIG. 5) extending from the fuel inflow port 26 to the feed pump 4.

Figure 6:
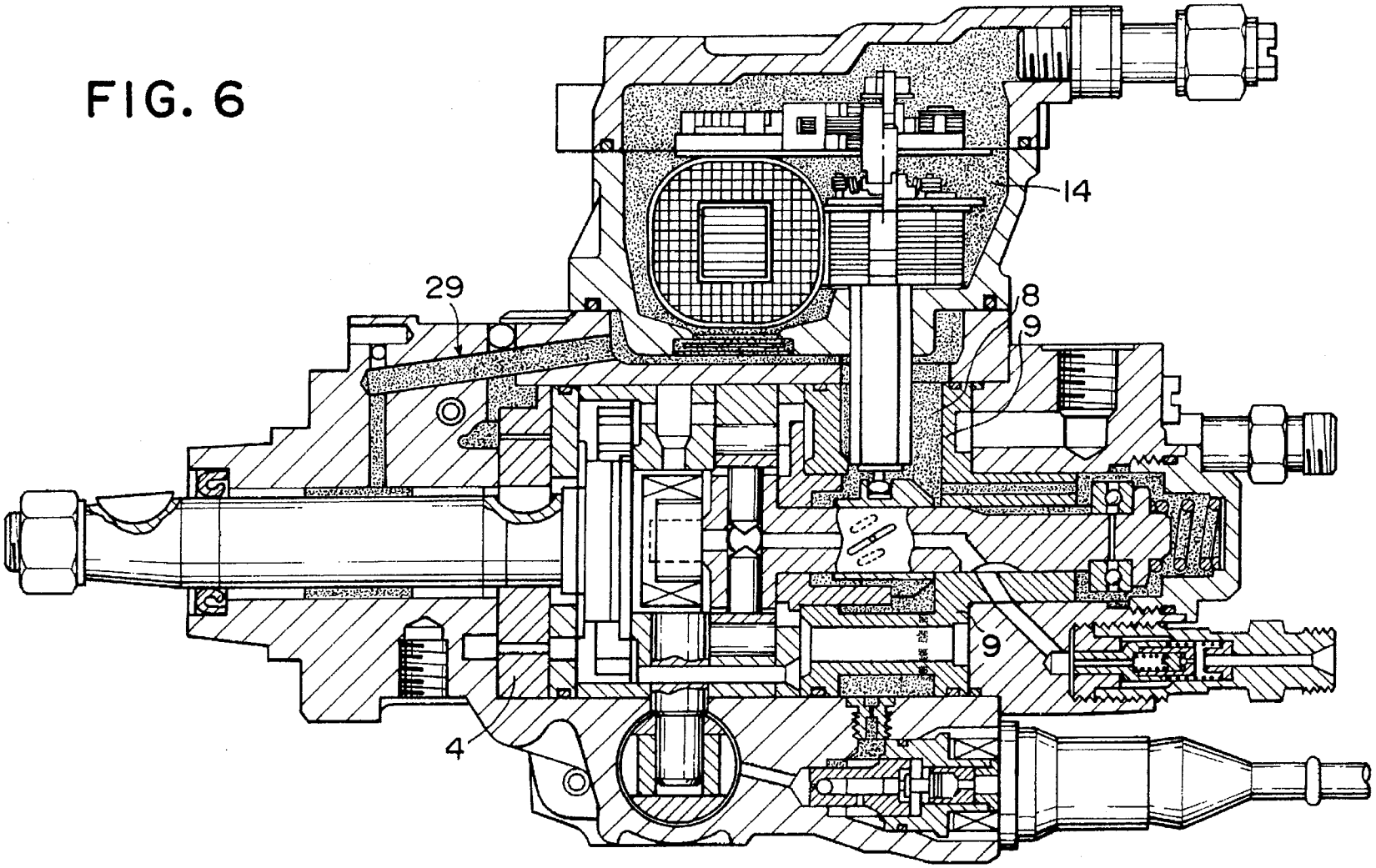
FIG. 6 illustrates a high pressure side fuel path in the distributor type fuel injection pump in FIG. 1.

In addition, the fuel that is compressed by the feed pump 4 is induced to the chamber 8 via a passage 5 formed in the upper part of the pump housing and a gap 7 which is formed between the pump housing 2 and the governor housing 6 that is mounted on top of the pump housing 2. The compressed fuel is also induced to an overflow valve 46 via the governor's storage chamber 14. It is further induced to the front end area of the rotating member 16 and a pressure equalizing port 47 formed at the rotating member 16 via a through-hole 9*d* formal at the fitting protrusion 9*a* of the partitioning body 9 in such a manner that the entire channel will constitute a high pressure side fuel path 29 which is illustrated by sanding over in FIG. 6.

A space 28 that is enclosed by the shoes 22 and the rotating member 16 is formed on the back surfaces of the shoes 22 and this space 28 communicates with the low pressure side fuel path 27 without any constriction, on the side that is closer to the fuel inflow port 26 (upstream side). While the cross section of this space 28 may be of any form or shape, it is desirable to ensure that the back pressure acting toward the cam ring 24 is applied evenly to the shoes 22. Such a space can be provided on both sides of each plunger 20 by boring holes in the direction of the shaft of the rotating member 16.

The rotating member 16 is provided with a longitudinal hole 30 formed in the direction of the shaft and communicating with the compression space 21, an inflow/outflow port 31 which communicates with the longitudinal hole 30 and which opens to the circumferential surface of the rotating member 16 and a distribution port 33 which allows communication between a distribution passage 32, which is formed to pass through the partitioning body 9 and the housing member 2*b*, and the longitudinal hole 30. The portion of the inflow/outflow port 31 where it opens onto the surface of the rotating member 16 constitutes an oblong hole and the direction in which the oblong hole extends is inclined at a specific angle relative to the direction of the shaft of the rotating member 16. Moreover, a control sleeve 34 is externally fitted on the rotating member 16 in such a manner that it can slide freely so as to cover the inflow/outflow port 31.

An intake hole 35 and a cutoff hole 36, which can communicate with the inflow/outflow port 31, are formed in the control sleeve 34. The intake hole 35 and the cutoff hole 36 are both constituted of oblong holes which incline at the same angle as the inflow/outflow port 31 relative to the direction of the shaft of the rotating member 16 and they are provided in such a manner that they lie parallel to the inflow/outflow port 31.

Consequently, when the rotating member 16 rotates, the inflow/outflow port 31 comes into communication with the intake hole 35 and the cutoff hole 36 of the control sleeve 34 in that order. During the intake process, in which the plungers 20 move in the direction in which they travel away from the center of the cam ring 24, the inflow/outflow port 35 and the intake hole 31 are aligned so that the fuel in the chamber 8 is taken into the compression space 21.

Then, when the operation enters the compression process, in which the plungers 20 move toward the center of the cam ring 24, communication between the inflow/outflow port 31 and the intake hole 35 is cut off and the distribution port 33 becomes aligned with one of the distribution passages 32 so that the compressed fuel is supplied to one of the outlet valves 10 via the distribution passage 32.

Note that the fuel sent out from the outlet valve 10 is sent to an injection nozzle via an injection pipe (not shown) and it is then injected into a cylinder of the engine from the injection nozzle.

When the inflow/outflow port 31 and the cutoff hole 36 become aligned during the compression process, the compressed fuel flows to the chamber 8 to stop the fuel supply to the injection nozzle and, consequently, to end the injection.

Since the timing with which the inflow/outflow port 31 becomes aligned with the cutoff hole 36 varies depending upon the position of the control sleeve 34, the injection ending, i.e., the injection quantity can be adjusted by adjusting the position of the control sleeve 34. As the control sleeve 34 is moved to the left in the figure, (towards the base end of the rotating member 16), the injection quantity is reduced and as it is moved toward the right (toward the front end of the rotating member 16), the injection quantity is increased.

To give a more detailed explanation; when the positional relationship between the control sleeve 34 and the rotating member 16 is as shown in FIG. 3B—①, the timing with which the inflow/outflow port 31 communicates with the intake hole 35 and the cutoff hole 36 is advanced by moving the control sleeve 34 to the right, to achieve the state shown in FIG. 3—②, and the area of the cam surface of the cam ring 24 that is used during the compression process shifts to the initial lift stage area (low cam speed area) and if the rotation rate of the rotating member 16 is the same, the injection quantity is reduced while the injection period remains the same. In contrast, when the positional relationship between the control sleeve 34 and the rotating member 16 is as shown in FIG. 3—②, the timing with which the inflow/outflow port 31 communicates with the intake hole 35 and the cutoff hole 36 is delayed by moving the control sleeve 34 to the left, to achieve the state shown in FIG. 3—①, and the area of the cam surface of the cam ring 24 that is used during the compression process shifts toward the high cam speed area to increase the injection quantity.

Note that the control sleeve 34 is provided with a connecting groove 37 which is formed within a specific range at a specific angle in the direction of the circumference of the upper surface and a ball 39, which is formed at the front end of the shaft 13, attached to the rotor 38 of the electric governor 12, is connected to the connecting groove 37. The ball 39 is provided by decentering from the shaft 13 and when the rotor 38 is rotated by an external signal, the control sleeve 34 is moved in the direction of the shaft of the rotating member 16.

The control sleeve 34 is also provided with a groove **34*a* extending in the direction of the shaft and part of the cylindrical portion 25*a* of the adapter 25 is inserted in the groove 34*a* so that the phase between the adapter 25 and the control sleeve 34** can be maintained constant at all times.

A timer device 40 adjusts the injection timing by converting the movement of a timer piston 41 to the rotation of cam ring 24. The timer piston 41 is housed in a cylinder provided at the bottom of the pump housing 2 in such a manner that it can slide freely and the timer piston 41 is linked to the cam ring 24 via a lever 42.

A high pressure chamber into which high pressure fuel from the chamber 8 is induced is formed at one end of the timer piston 41 and a low pressure chamber which communicates with the low pressure side fuel path 27 is formed at the other end. Furthermore, a timer spring is provided in the low pressure chamber in such a manner that it exerts a constant force to the timer piston 41 toward the high pressure chamber. As a result, the timer piston 41 rests at a position where the pressure exerted by the timer spring is in balance with the fuel pressure in the high pressure chamber. When the pressure in the high pressure chamber increases, the timer piston 41 moves toward the low pressure chamber against the force of the timer spring so that the cam ring 24 is rotated in the direction that hastens the injection, thereby advancing the injection timing. In contrast, when the pressure in the high pressure chamber decreases, the timer piston 41 moves toward the high pressure chamber so that the cam ring 24 is rotated in the direction that delays the injection, thereby retarding the injection timing.

In short, when the positional relationship between the control sleeve 34 and the rotating member 16 is as shown in FIG. 4—①, if the timer piston 41 moves toward the low pressure side, to rotate the cam ring 24 in the direction that advances the injection timing, with the rotation of the cam ring 24, the control sleeve 34 is rotated in the same direction to the same angle via the adapter 25 and the timing with which the inflow/outflow port 31 communicates with the intake hole 35 and the cutoff hole 36 is hastened (the state shown in FIG. 4, ②). As a result, although the area of the cam ring 24 which is used during the compression process does not change, the characteristics curve of the cam lift is shifted in the direction which advances the overall injection timing, as shown in FIG. 4, because of the rotation of the cam ring 24.

In contrast, when the positional relationship between the control sleeve 34 and the rotating member 16 is as shown in FIG. 4—②, if the timer piston 41 moves toward the high pressure side, to rotate the cam ring 24 in the direction that delays the injection timing, with the rotation of the cam ring 24, the control sleeve 34 is rotated in the same direction to the same angle via the adapter 25 and the timing with which the inflow/outflow port 31 communicates with the intake hole 35 and the cutoff hole 36 is delayed (the state shown in FIG. 4, ①). As a result, although the area of the cam ring 24 which is used during the compression process does not change, the characteristics curve of the cam lift is shifted in the direction which delays the overall injection timing because of the rotation of the cam ring 24.

Note that the pressure in the high pressure chamber of the timer is adjusted by a timing control valve (TCV) 43 so that the required timer advance angle can be achieved. This timing control valve 43 is provided with an entrance portion which communicates with the chamber 8 and, at the same time, communicates with the high pressure chamber side of the timer piston 41, formed at its side. It is also provided with an exit portion, which communicates with the low pressure chamber side of the timer piston 41 formed at the front end portion. Inside the timing control valve 43, a needle 44, which opens and closes communication between the entrance portion and the exit portion, is housed. A constant force is applied to the needle 44 in the direction that cuts off the communication between the entrance portion and the exit portion by a spring. When the needle is pulled against the force of the spring by supplying power to the solenoid 45, the entrance portion and the exit portion communicate with each other to open communication between the high pressure chamber and the low pressure chamber.

In other words, when no electric current is running to the solenoid 45, the high pressure chamber and the low pressure chamfer are completely cut off from each other, but when an electric current is running to a solenoid 45, the high pressure chamber and the low pressure chamber become connected to reduce the pressure in the high pressure chamber. Thus, as the pressure in the high pressure chamber changes, the timer piston 41 moves to a position where it is in balance with the force of the timer spring, which in turn causes the cam ring 14 to rotate to change the injection timing. Note that it is desirable to perform control of the timing control valve 43 through duty ratio control.

In the structure described above, the inside of the pump housing 2 is partitioned into the low pressure side fuel path 27 which is filled with low pressure, low temperature fuel flowing in from the fuel inflow port 26 and the high pressure side fuel path 29 filled with fuel compressed by the feed pump 4 and which is maintained at a relatively high pressure. Since the low pressure, low temperature fuel flowing through the low pressure side fuel path 27 is sent to the feed pump 4 after travelling through the gap between the cam ring 24 and the shoes 22 and the rollers 23. As a result, the area where the cam ring 24 and the rollers 23 come in contact, and the area of contact between the rollers 23 and the shoes 22 which tend to acquire friction heat as the rotating member 16 rotates, are cooled. This also assures smooth operation, as lubrication of the area surrounding the rollers is promoted.

Moreover, since low pressure, low temperature fuel flows without constriction from the fuel inflow port side into the space 28 formed at the rotating member 16 behind the shoes 22, there is no reduction in fuel pressure due to passage resistance, unlike the case of the fuel that travels between the cam ring 24, the shoes 22 and the rollers 23 (space **27*b*). Consequently, the fuel pressure in the space 28 is relatively high compared to the fuel pressure in the space 27*b*. This creates a pressure differential between the plunger side of the shoes 22 and the cam ring side of the shoes 22, which exerts a force on the shoes 22 toward the cam ring. The jump of the rollers 23 and the shoes 22** is thus reduced and the turbulence of the fuel injection characteristics is minimized.

Furthermore, since the control sleeve 34 is in synchronization with the movement of the timer piston 41 via the adapter 25 and the cam ring 24, it is not necessary to take into account the movement of the timer piston 41 in order to adjust the injection quantity when performing timer control. Timer control and injection quantity control can, thus, he performed independently of each other. Although the linking of the control sleeve with the timer piston 41 is implemented over the partitioning body 9, since the adapter 25 is fitted in the partitioning body 9 with good oil tightness, the pressure differential between the low pressure side fuel path 27 and the chamber 8 is maintained.

Figure 7:
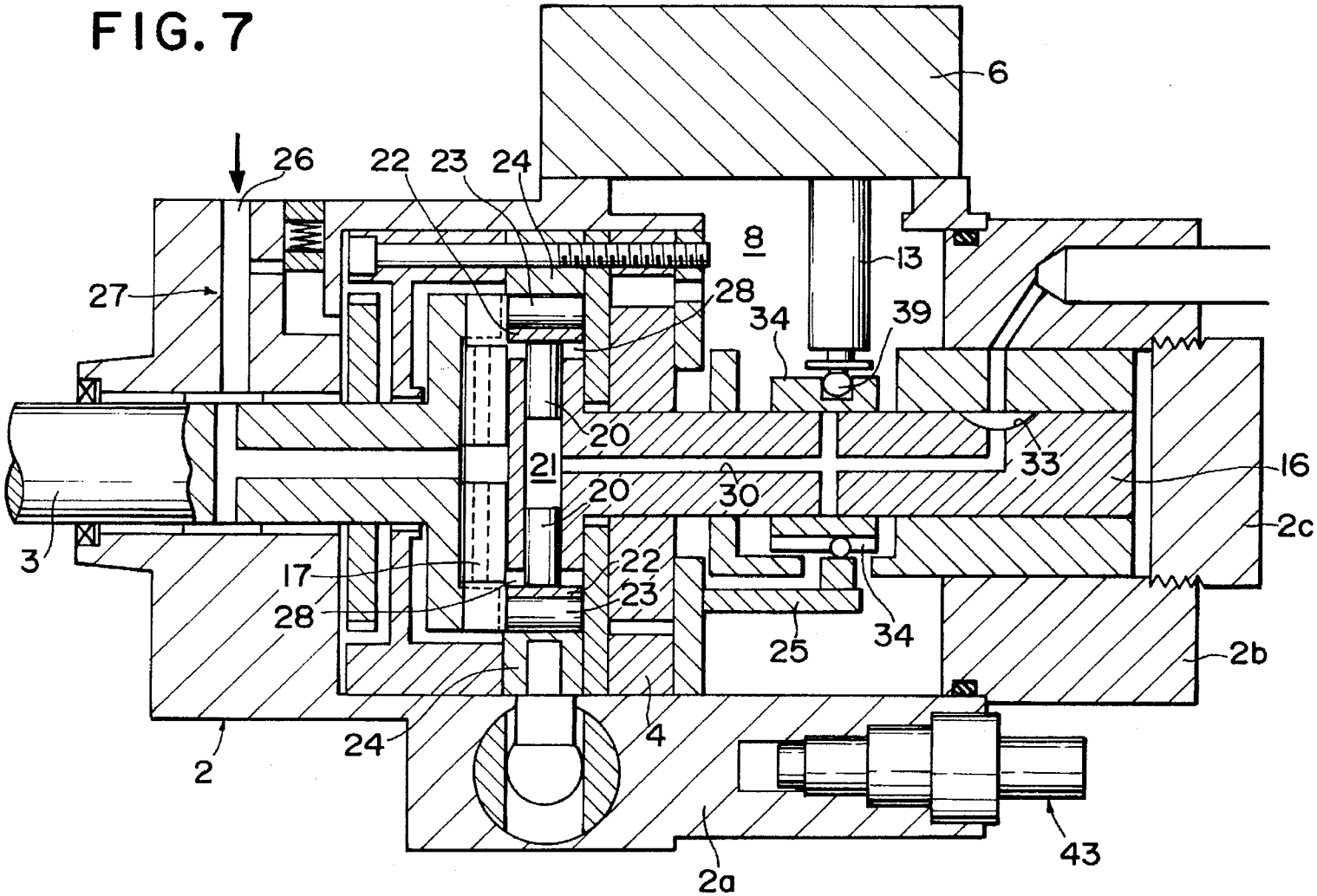
FIG. 7 is a schematic structure diagram of another example of a distribution fuel injection pump according to a second embodiment of the present invention.

Note that, in order to promote the cooling of the cam ring 24, the shoes 22 and the rollers 23, a low pressure side fuel path 27 my be structured as shown in FIG. 7, in such a manner that the fuel inflow port 26 is provided toward the drive shaft relative to the feed pump 4. The low pressure side fuel path 27 extends from the fuel inflow port 26 through the periphery of the drive shaft 3, through the gaps between the coupling 17, the cam ring 24, the shoes 22 and the rollers 23 to reach the feed pump 4. In this arrangement, the feed pump 4 itself partitions the low pressure side fuel path 27 which is formed extending from the fuel inflow port 26 to the feed pump 4 from the chamber 8 into which the pressurized fuel is induced by the feed pump and which can communicate with a port which takes in and cuts off the fuel.

In this structure, too, a space 28 which communicates with the low pressure side fuel path 27 may be provided between the back surfaces of the rollers and the rotating member 16 without constricting the fuel inflow port side (upstream side) separately from the gap between the cam ring 24, the shoes 22 and the rollers 23, to inhibit jumping of the plungers 20 by applying the fuel pressure on to the back surfaces of the shoes 22. It my also take a structure in which, in order to eliminate phase misalignment between the control sleeve 34 and the cam ring 24, the adapter 25 which is linked to the cam ring 24 is connected and stopped in a groove **34*a* formed in the control sleeve 34**.

Figure 8:
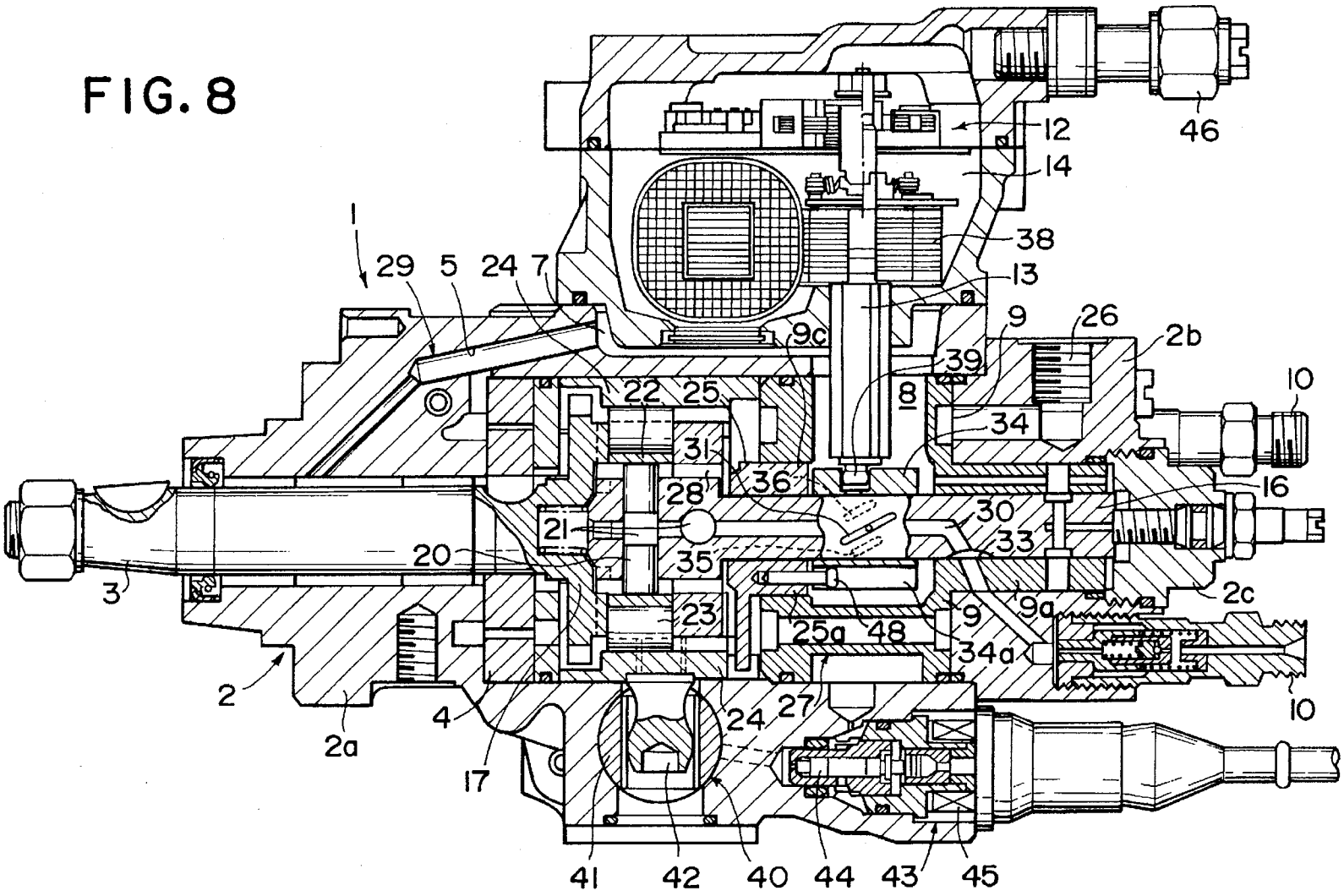
FIG. 8 is a cross section of yet another example of a distribution fuel injection pump according to a third embodiment of the present invention.

FIG. 8 shows another example of the distributor type fuel pump according to the present invention. The following is explanation of mainly the differences from the earlier example. Where the structure is identical, the sane reference numbers are assigned to components that are identical to those in the earlier example and their explanation is omitted.

Figure 9:
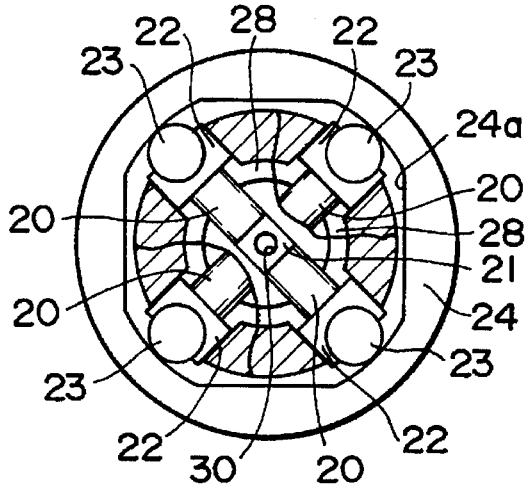
FIG. 9 shows a cam ring of FIG. 8 and the members inside it, viewed from the direction of a shaft of a rotating member.

The plungers 20 are inserted in the rotating member 16, which is linked to the drive shaft 3 of the distributor type fuel injection pump, in the direction of the radius (radial direction) at the base end in such a manner that the plungers 20 can slide freely. In this embodiment, as shown in FIG. 9, two sets of plungers are provided with each set having two plungers 20 facing opposite each other with their phases offset by 180°. The alignment of the two sets of plungers 20 relative to the direction of the shaft of the rotating member 16 are offset by 90°. In the case of the first embodiment, it is necessary to ensure that all four plungers facing the compression space 21 will not interfere. However, in the structure in this embodiment, interference between only the two plungers that face opposite each other has to be considered. This means that compression efficiency is improved and at the same time, the structure allows a greater degree of freedom in designing the form of the cam.

The two sets of plungers 20, which move back and forth in the direction of the shaft in this manner, come in contact with the inner surface of the common ring-like cam ring 24 by sliding via the shoes 22 and the rollers 23. This cam ring 24 is provided concentrically to and around the rotating member 16. At the same time, it is provided with cam surfaces **24*a* on the inside, the number of which corresponds to the number of cylinders in the engine. For instance, to form cam surfaces 24***a* in correspondence with 4 cylinders, protruded surfaces are formed on the inside of the cam ring 24 every 90° and, as a result, the four plungers 20 move simultaneously toward the center of the cam ring 24, constricting the compression space 21 and thereby compressing it. Alternately, the four plungers 20 also move away from the center of the cam ring 24 simultaneously.

In addition, between the front end and the base end of the rotating member 16 the ring-like adapter 25 is externally fit oil tight in such a manner that it can slide freely. This adapter 25 rotates in synchronization with the cam ring 24 with part of the circumferential edge being held in the groove formed in the cam ring 24 for instance. As in the previous embodiment, the cylindrical portion 25*a*, which extends towards the front end of the rotating member 16, is fitted in the fitting hole 9*c* formed in the partitioning body 9 with good oil tightness in such a manner that it can slide. A positioning member 48, provided at the cylindrical portion, is inserted in the groove 34*a* formed in the control sleeve 34 to ensure that the phase between the adapter 25 and the control sleeve 34 is maintained constant at all times.

Note that the timer device 40 is provided under the cam ring 24 and the timer piston 41 is directly linked with the cam ring 24 via a lever 42.

In such a structure, too, apart from the advantages gained by a different arrangement of the plungers 20, advantages similar to those achieved in the previous embodiment are obtained.

Figure 10:
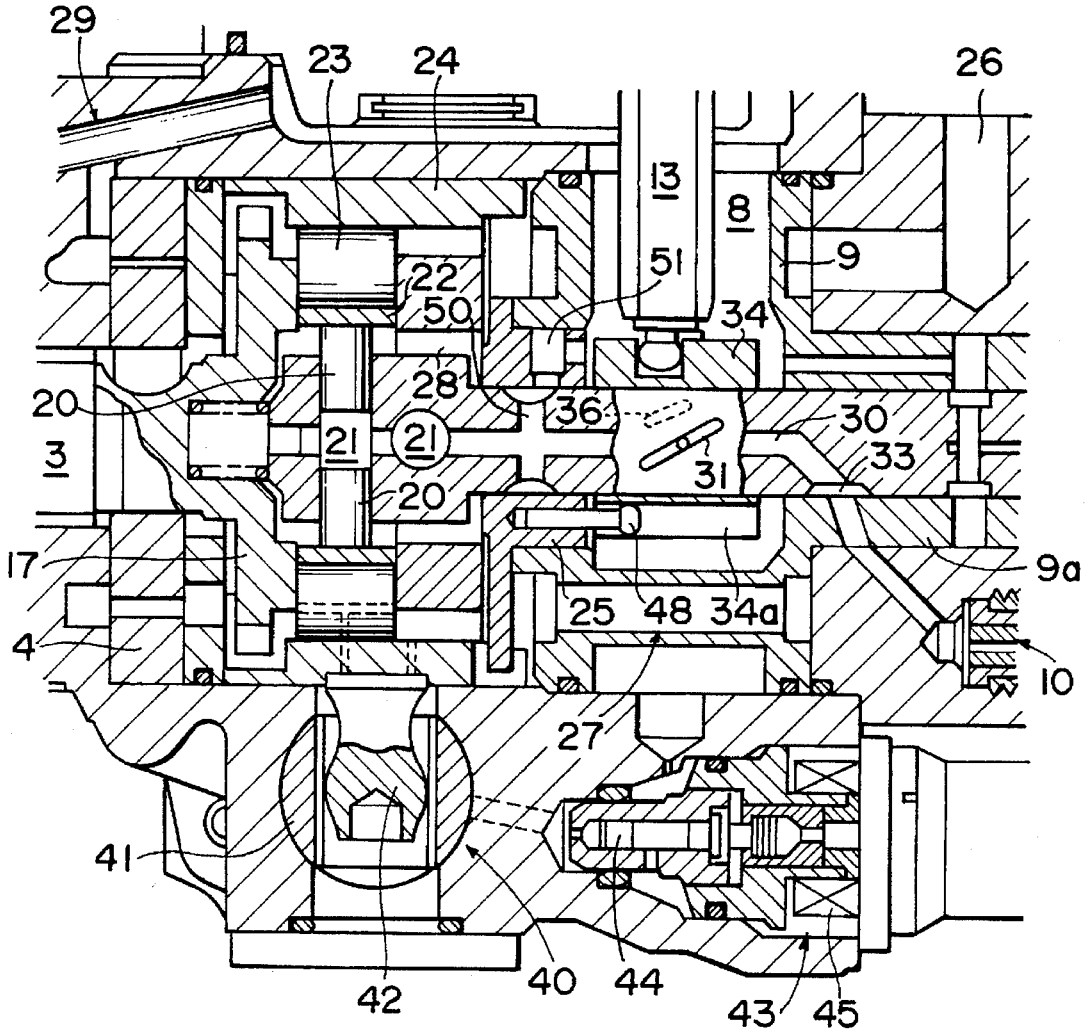
FIG. 10 is an enlarged cross section of the essential parts of yet another example of a distribution fuel injection pump according to a fourth embodiment of the present invention.

A possible variation of the distributor type fuel injection pump shown in FIG. 8 is presented in FIG. 10. In this distributor type fuel injection pump, the inflow/outflow port 31 is used only as a port for fuel cutoff and only a cutoff hole 36 is formed in the control sleeve 34. In the rotating member 16 an intake port 50 is formed in an area that is further toward the base end relative to the port for fuel cutoff and where it is covered with the adapter 25. An intake passage 51, one end of which can communicate with the intake port 50 and the other end of which opens into the chamber 8 is formed in the adapter 25.

Figure 11:
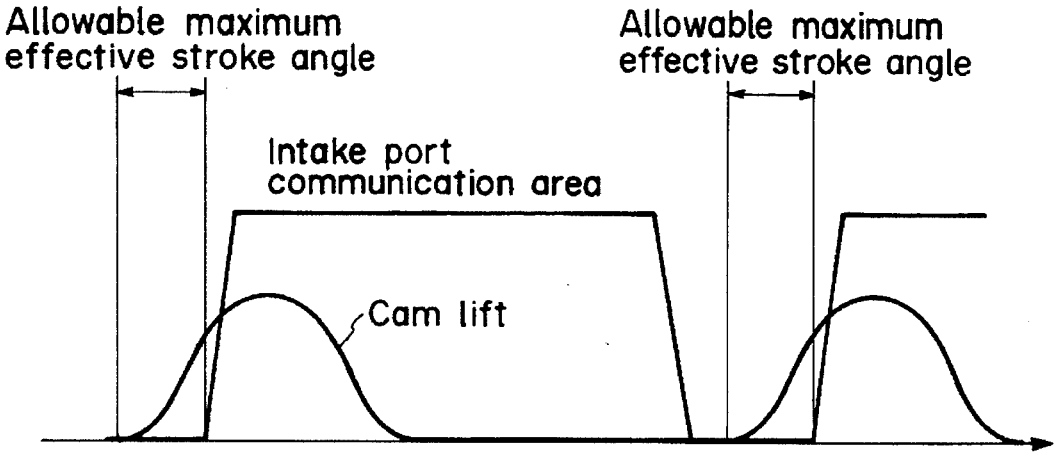
FIG. 11 is a diagram illustrating the period over which the intake port of the distributor type fuel injection pump shown in FIG. 10 communicates with the chamber.

The intake port 50 and the intake passage 51 start to communicate with each other at a specific position where the cam lift increases as shown in FIG. 11 and their communication is cut off before the next compression process starts. As a result, the interval from the start of cam lift through the time when the intake port opens into the chamber is the allowable maximum effective stroke with which compression is possible.

In such a structure, since the fuel in the chamber 8 is taken into the compression space 21 from a position that is closer than the control sleeve, the efficiency of fuel intake improves. Moreover, since the intake port 50 opens into the chamber when a specific degree of cam lift is achieved, even when the cutoff timing is greatly delayed due to failure of the electric governor, the compressed fuel is leaked into the chamber via the intake port 50 and the intake passage 51 when the specific cam lift is achieved, to effect the cutoff. This eliminates the likelihood of fuel pressure in the rotating member rising to an abnormal level. As has been explained, according to the present invention, since a low pressure side fuel path that is partitioned from the chamber is formed in the housing and a cam ring, shoes and rollers are positioned in this low pressure side fuel passage, the cooling of the cam ring, shoes and the rollers can be performed efficiently with the low temperature, low pressure fuel flowing in from the fuel inflow port. At the same time, lubrication is promoted by the fuel induced between the cam ring, the shoes and the rollers, achieving an overall advantage of reduced wear on parts.

Furthermore, since the space is provided between the shoes and the rotating member and the space and the low pressure side fuel path communicate without constriction on the fuel intake port side, jumps of the rollers and the shoes are inhibited, achieving stable fuel characteristics. Also, since the force applied to the cam in the downward direction increases, the efficiency of fuel intake improves and it becomes possible to operate the pump in a stable manner even at high rotation rates.

In addition, since the phase between the control sleeve and the cam ring is fixed by the adapter, the fuel injection quantity control and the advance angle control can be performed separately and independently. Furthermore, since the adapter constitutes a part of the member which partitions the low pressure side fuel path from the chamber, the pressure deferential between the low pressure side fuel path and the chamber can be maintained. Thus, the pressure in the chamber that is required for the intake process is assured, ensuring that operation can be performed throughout the high rotation rate range.

Moreover, since the fuel in the chamber is induced to the compression space via the intake passage formed in the adapter and the fuel intake port covered by the adapter, the fuel can be taken in from a location close to the compression space, improving the efficiency of fuel intake. In addition, with the intake passage and the fuel intake port formed in such a manner that the fuel intake port and the chamber communicate with each other when a specific lift is achieved during the compression process, even if the electric governor has a problem, greatly delaying the cutoff timing, the compressed fuel is leaked via the intake passage and the fuel intake port when the lift reaches a specific level, thereby preventing an abnormal increase in fuel pressure and preventing damage to the pump and the like.

What is claimed is:

1. A fuel injection pump comprising:

a housing;

a rotatable member which is supported in said housing, said rotatable member having a base end defining a compression space, a longitudinal fluid passage communicating with said compression space, and an inflow/outflow port communicating with said longitudinal passage;

a plurality of plungers slidably mounted in said base end and radially spaced around said rotatable member to move into and out of said compression space;

a cam ring provided around said plungers, and positioned so as to be concentric with said rotatable member;

a plurality of shoes provided at one end of said plungers, respectively;

a plurality of rollers provided on said plurality of shoes, respectively, and located between said shoes and said cam ring;

a fuel inlet port provided in said housing;

a fuel feed pump mounted in said housing;

a structure partitioning said housing into a low pressure side fuel path extending from said fuel inlet port to said feed pump, and a chamber in fluid communication with said feed pump and which can communicate with said compression space via said inflow/outflow port in said rotatable member, and wherein said cam ring, said shoes, and said rollers are located in said low pressure side fuel path.

2. The fuel injection pump as claimed in claim 1, wherein said plurality of plungers include two pairs of plungers which are out of phase by 180 degrees, and cam surfaces are formed on an interior surface of said ring and are engagable with said plurality of plungers to simultaneously move said pairs of plungers toward a center of said cam ring.

3. The fuel injection pump as claimed in claim 1, wherein said low pressure side fuel path includes a space between said shoes and said cam ring such that fluid flowing into said space will apply a pressure to said shoes to bias said shoes toward said cam ring.

4. The fuel injection pump as claimed in claim 1, wherein said cam ring includes camming surfaces formed on an inside surface of said cam ring, and said surfaces are engagable with said plurality of plungers to simultaneously move said plungers toward a center of said cam ring and to simultaneously move said plungers away from the center of said cam ring.

5. The fuel injection pump as claimed in claim 4, wherein said plungers are aligned in a plane which is perpendicular to said rotatable member.

6. The fuel injection pump as claimed in claim 1, further comprising a drive shaft coupled with said rotatable member, wherein:

said fuel inlet port is located nearer to said drive shaft than said feed pump, and said feed pump constitutes said partitioning structure.

7. The fuel injection pump as claimed in claim 6, further comprising:

a control sleeve mounted on said rotatable member for opening and closing said inflow/outflow port; and an adapter operably connected to said cam ring and to said control sleeve, wherein movement of said control sleeve is limited by said cam ring.

8. The fuel injection pump as claimed in claim 1, wherein:

said fuel inlet port is positioned closer to said chamber than said feed pump.

9. The fuel injection pump as claimed in claim 8, further comprising:

a control sleeve mounted on an external surface of said rotatable member and having a cutoff hole which can selectively communicate with said inflow/outflow port provided in said rotatable member; and an adapter mounted on said rotatable member and engaging said control sleeve and said cam ring, wherein movement of said control sleeve is limited by said adapter.

10. The fuel injection pump as claimed in claim 9, wherein said adapter constitutes part of said partitioning structure.

11. The fuel injection pump as claimed in claim 9, wherein said control sleeve further includes an intake hole, said inflow/outflow port is covered by said control sleeve, and said intake hole, when aligned with said inflow/outflow port, allows communication between said chamber and said compression space.

12. The fuel injection pump as claimed in claim 9, wherein said intake hole, said cutoff hole and said inflow/outflow port have the form of parallel extending oblong holes which are inclined in a direction of rotation of said rotatable member.

13. The fuel injection pump as claimed in claim 12, wherein said control sleeve intake hole permits fuel from said chamber to flow to said compression space.

* * * * *